US005457287A

United States Patent [19]

Shimozawa et al.

[11] Patent Number: 5,457,287

[45] Date of Patent: Oct. 10, 1995

[54] COAXIAL ELECTRICAL CABLE

[75] Inventors: Katsuo Shimozawa, Haitu Shouwatoti; Yutaka Asami, Komagawa, both of Japan

[73] Assignee: Junkosha Co., Ltd., Japan

[21] Appl. No.: 245,508

[22] Filed: May 18, 1994

[30] Foreign Application Priority Data

May 20, 1993 [JP] Japan ..... 5-031609 U

[51] Int. Cl.[6] ..... H01B 11/18

[52] U.S. Cl. ..... 174/102 R; 174/36; 174/109; 174/117 F

[58] Field of Search ..... 174/36, 102 R, 174/109, 117

[56] References Cited

U.S. PATENT DOCUMENTS 3,790,694 2/1974 Portinari ..... 174/23 R
3,917,900 11/1975 Arnaudin, Jr. ..... 174/107
4,552,989 11/1985 Sass ..... 174/103
5,107,076 4/1992 Bullock et al. ..... 174/107
5,170,010 12/1992 Aldissi ..... 174/36
5,321,202 6/1994 Hillburn ..... 174/36

*Primary Examiner*—Morris H. Nimmo
*Attorney, Agent, or Firm*—Gary A. Samuels

[57] ABSTRACT

A shielded coaxial electrical cable for transmission of electrical signals in which very fine wires or light-weight foils are used as shielding materials. The shielding materials are held in place by an adhesive to prevent dislodgement or misalignment of the shielding materials by forces exerted upon them during subsequent manufacturing steps.

19 Claims, 1 Drawing Sheet

COAXIAL ELECTRICAL CABLE

FIELD OF THE INVENTION

The invention relates to coaxial electrical cables for electrical signal transmission, and more particularly to coaxial cables using lightweight metallic materials for shielding against extraneous electromagnetic radiation.

BACKGROUND OF THE INVENTION

A coaxial electrical cable for high speed transmission of electric signals generally comprises a metallic inner conductor surrounded by a dielectric insulating material, which in turn is surrounded by an electrically-conductive outer material that provides a shield against passage of extraneous external electrical signals or noise which might interfere with signals carried by the inner conductor, or against passage of signals or noise generated by the inner conductor. Generally, a third layer of dielectric material surrounds the coaxial assembly which provides a sheath or jacket for protection against the use environment and to provide additional insulation. Coaxial electrical cables comprising the elements described above in single layers or in multiple coaxial layers are well known in the art.

As industry trends toward smaller and lighter weight coaxial cables formed of generally circular sequential layers of materials problems have arisen which are difficult to meet with current art without sacrificing desirable properties. One such problem is the maintenance of the position and alignment of the shielding materials during subsequent manufacturing steps. This can also be the case in the manufacture of coaxial cables having asymmetric shapes and other non-circular cross-section shapes.

Shielding materials may include metals or metallized plastic film in the form of wire, tape, or foil which are conventionally applied to surround a dielectric material layer by methods such as braiding, serving (helical wrapping), or folding (cigarette-style wrap). These materials are generally applied so that about 80% or more of the dielectric material surface is uniformly covered by the material in order to provide uniform shielding. If the shielding material is dislodged or its alignment distorted shielding effectiveness is reduced and the cable may be unusable.

In most cases in which wire, tape, or foil shielding materials are used the materials are sufficiently strong that they can be applied with enough back tension so that, once in place, they can resist the forces exerted on them by subsequent manufacturing steps and remain in place. However, when very fine wire or thin foils and tapes are used it is difficult to apply them to the surface of the dielectric material in a manner that resists displacement by subsequent manufacturing steps. In order to overcome these problems heavier gauge shielding materials may be required which runs counter to the desire for smaller, lighter, and more flexible cables.

The problem is more severe in cable constructions having served-wire or served-tape shielding, which are frequently desired for the flexibility which can be obtained in the cable. Served shielding is the most easily displaced type of shielding. Displacement of the shielding by subsequent manufacturing steps can also be a problem in the manufacture of coaxial cables that have non-circular cross-section shapes. Non-circular cross-section coaxial cable shapes such as are disclosed in U.S. Pat. No. 4,701,576 (to Wada, et al.) and U.S. Pat. No. 5,119,046 (to Koslowski, et al. ) may use pressure-extrusion methods to shape and mold the outer protective jackets. Such pressure-extrusion methods exert much higher forces on the coaxial cable materials already in place than are encountered in conventional extrusion of cable jackets and, consequently, are more likely to dislodge or displace shielding materials already in place.

It is an object of the invention to provide a coaxial cable in which the shielding material is held in place so as to not be disturbed or displaced by subsequent manufacturing operations or use.

SUMMARY OF THE INVENTION

To overcome the above difficulties a coaxial electrical cable was developed in which the shielding material is fixed in place by a layer of adhesive so that forces exerted on the shielding material by subsequent manufacturing steps will not cause displacement of the shielding material.

Specifically, the invention is an electrical coaxial cable comprising: (a) an electrical conductor; (b) a first layer of dielectric material surrounding the conductor; (c) a second layer of dielectric material which comprises a tape, coated on at least one side with an adhesive, surrounding the first layer of dielectric material in such a way that an adhesive coated surface faces outward; (d) a layer of electrically-conductive shielding material which surrounds and is in contact with the adhesive; and (e) a third layer of dielectric material which surrounds the shielding material. The shielding material is applied to the assembly so that it contacts the adhesive which holds the shielding material in place so that it is not displaced by subsequent insulating, shielding, or jacketing steps which may occur in the course of manufacture of the coaxial cable.

DETAILED DESCRIPTION OF THE INVENTION

Figure 1:
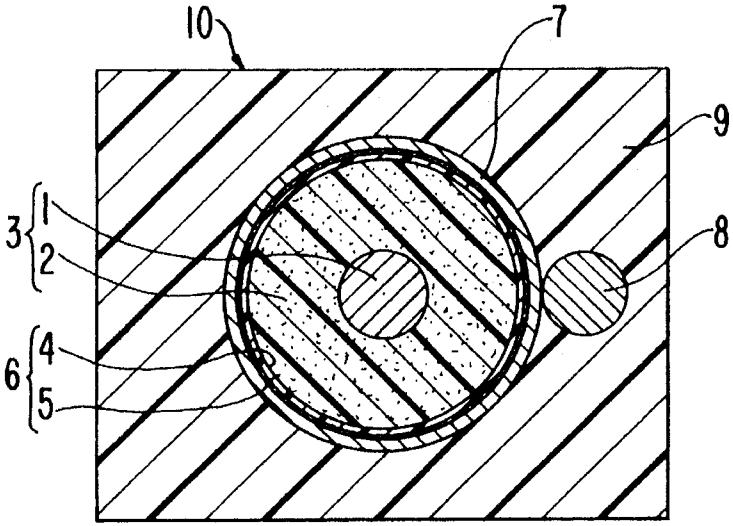
FIG. 1 is a cross-sectional view of an embodiment of the invention.

The invention is now described in detail and with reference to the accompanying drawings in order to more clearly delineate the scope of the invention. Referring now to the drawings, FIG. 1 describes a coaxial cable 10 for transmission of electric signals wherein the signal carrying inner conductor 1 is surrounded by a dielectric material 2 to form a coaxial core assembly 3. A second dielectric layer 6 comprising a tape 4 of electrically-insulating material coated on one side with a layer of adhesive 5 surrounds the coaxial core assembly 3 in a configuration such that the adhesive surface faces radially outward. A layer of electrically-conductive shielding material 7 surrounds the dielectric layer 6. The shielding material 7 contacts and is fixed in place by the adhesive 5. A drain wire 8 is shown placed along the shielding material 7 for illustrative purposes. The drain wire may be located at other positions next to the shielding material, or may be omitted from the cable. A third layer of dielectric material surrounding the shielding material 7 is shown in the form of a rectangular-shaped extruded jacket 9.

The signal carrying conductor 1 can be any electrical conductor suitable for carrying electric signals and can be selected from many known in the art according to the end use intended for the cable. The dielectric material 2 of the core assembly 3 is preferably a layer of porous dielectric having a pore volume in the range about 60% to 95%. Preferably the dielectric material 2 is porous polytetrafluoroethylene, most preferably porous expanded polytetrafluoroethylene, however, other highly porous polymeric dielectric materials such as porous polypropylene, porous polyethylene, porous polyurethane, or a porous fluoropolymer other than porous polytetrafluoroethylene can also be used. Many such materials are known in the art and are routinely used. The porous dielectric material may be applied to the inner conductor 1 by tapewrapping, extruding, foaming, or other methods known in the art.

Surrounding the dielectric material 2 is a second layer of dielectric material 6 comprising an electrically insulative tape 4 coated with a nonconductive adhesive layer 5. The insulative tape can be made of dielectric synthetic polymers including polyolefins, polyesters, polyurethanes, fluoropolymers, and the like. A preferred material for the insulative tape 4 is a polyester film. The polymer forming the adhesive layer 5 may be selected from many known in the art. Preferably, the adhesive polymer is a heat-meltable or heat-activated adhesive and can be a thermoplastic, thermosetting, or reaction curing type selected from the classes including, but not limited to, polyamides, polyacrylamides, polyesters, polyolefins, polyurethanes, fluoropolymers, chlorocarbons, and the like. The adhesive may be coated on the tape by conventional means such as roll coating, dip coating, gravure printing, spray coating, powder coating, and the like. Selection of the materials forming the dielectric layer 6 are made according to the physical and electrical properties required by the intended use of the cable as well as process considerations and material costs. A preferred combination is an electrically-insulative tape 4 of polyester film coated with an adhesive layer 5 of a thermoplastic polymer such as polyvinyl chloride. This combination provides good strength, flexibility, and dielectric properties in addition to good processability and reasonable materials cost; and is suitable for use in a broad range of coaxial electrical cables. It is apparent, however, that for coaxial cables having special performance requirements, for example, high temperature resistance, other combinations of materials may be preferred, and can be used with equal success. Also, for certain applications, it may be desirable to adhere the dielectric layer 6 to the dielectric material 2 of the core assembly 3 in order to reduce shifting in the relative position of the layers. In these cases, the electrically-insulative tape 4 can be coated on both sides with an adhesive by the methods described above. The composite dielectric material layer 6 thus produced is applied to the core assembly 3 by conventional means such as tape-wrapping, folding, and the like.

Electrically-conductive shielding material 7 is then applied to surround the dielectric material layer 6. The shielding material 7 is a material containing electrically-conductive metal such as, for example, round or flat wire braid, helically-wrapped metal-coated polymer tape layers, helically-wrapped metal foil, served metal wire, and the like. Such materials are routinely used in coaxial cable constructions to provide protection against extraneous electrical signals or noise and are well known in the art, as are the means to apply them. It is important that the shielding material 7 be applied so that surface of the adhesive layer 5 is in contact with the shielding material in order to fix the shielding material in place. This is particularly important in those cases where wire shielding material is applied in a manner such that small gaps, which enhance flexibility, are present between the wires. After the shielding material has been applied it is fixed in place by melting or activating the adhesive to adhere to the shielding material, for example, by passage of the coaxial assembly through an oven. The shielding material thus adhered and fixed in place is now resistant to forces exerted against it in subsequent manufacturing steps which would otherwise be strong enough to dislodge it from its uniform positioning, thereby reducing or destroying its shielding effectiveness. A further benefit is that adhesively fixing the shielding material in place enables the use of very fine shielding wire, thereby reducing the size and weight of the coaxial cable.

Having adhesively fixed the shielding material in place the coaxial assembly is then subjected to additional manufacturing steps. These may include application of additional layers of dielectric materials, mechanical reinforcing, shielding, and/or placement of one or more drain wires, but more often involve completion of the coaxial cable 10 wherein the third layer of dielectric material 9 surrounding the shielding material 7 and drain wire 8 (if used) is a jacket for environmental protection. Suitable dielectric materials useful for the jacket include polyvinyl chloride, chlorinated elastomers and other rubbers, polyurethanes, and fluoropolymers, for example. The dielectric materials of the jacket can be applied by tape-wrapping methods, conventional extrusion methods or, to obtain non-circular cross-section shaped cables as depicted in FIG. 1, by pressure extrusion methods.

Figure 2:
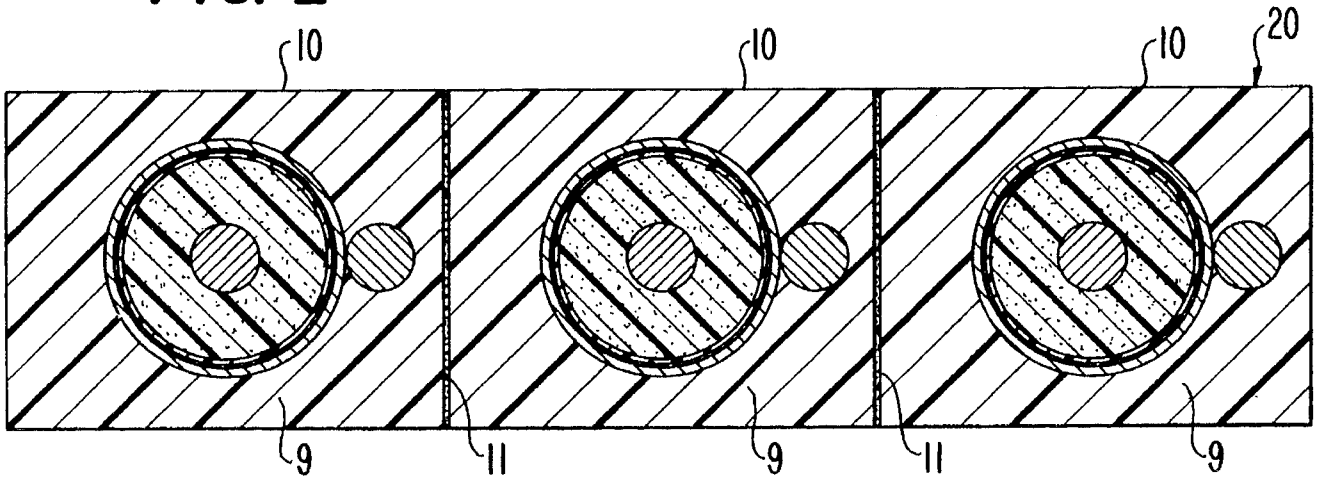
FIG. 2 is a cross-sectional view of a flat cable assembly formed using the embodiment of the invention shown in FIG. 1.

Non-circular cross-section shaped cables having at least two matching planar surfaces can be readily joined together to form multiconductor cable assemblies. One such assembly is illustrated in FIG. 2 wherein a flat multi-conductor cable assembly 20 is formed by adhering together parallel planar surfaces of the jackets 9 of the coaxial cables 10 of the invention at joints 11. The cables 10 are joined by heat fusion or with the use of adhesives.

EXAMPLE 1

A coaxial cable of the invention was prepared as follows:

An inner electrical conductor 1 of silver-coated copper alloy wire having a diameter of 0.203 mm was tape-wrapped with a dielectric material 2 of porous polytetrafluoroethylene tape.

The porous polytetrafluoroethylene tape was porous expanded polytetrafluoroethylene tape manufactured by Japan Gore-Tex, Inc. and had a thickness of about 75 micrometers. Three layers of the porous expanded polytetrafluoroethylene tape were tape-wrapped on the inner conductor with about 50% overlap to produce a coaxial core assembly 3 having an outside diameter of 0.60 mm and a signal speed of 3.8 nanoseconds/meter in the conductor.

A polyester film tape 4 having a thickness of about 4 micrometers and coated with a 4 micrometers thick adhesive layer 5 of heat-meltable polyvinyl chloride was tape-wrapped with a slight overlap over the coaxial core assembly 3 to form a second dielectric material layer 6 having an outside diameter of about 0.62 mm.

An assembly of 40 tin-coated annealed copper wires (wire diameter—0.05 mm) was helically wound around the dielectric material layer 6 to form a tightly wound layer of electrically-conductive shielding material 7. The shielding wires were fused to the dielectric material layer by passing the assembly through an air oven (oven length—1 m) set at 170° C. at a rate of 2 meters/minute to melt the polyvinyl chloride adhesive 5 and fix the shielding material in place.

A drain wire 8 was placed alongside and in contact with the shielding material 7. A third layer of dielectric material 9 of polyvinyl chloride was pressure extruded directly around the shielding material 7 and drain wire 8 to form a rectangular shaped outer jacket having a short side of 1.05 mm and a long side of 1.27 mm.

The coaxial cable thus formed was examined and it was confirmed that the close alignment of the individual wires of the shielding material had been maintained and were not disturbed by the high forces exerted against them during extrusion.

We claim:

1. A coaxial electrical cable comprising:

(a) an electrical conductor;

(b) a first layer of porous dielectric material surrounding the conductor;

(c) a second layer of dielectric material comprising a tape, coated on at least one side with an adhesive, surrounding said first layer of dielectric material in a manner such that at least one adhesive coated surface faces radially outward;

(d) a layer of electrically-conductive shielding material surrounding said second layer of dielectric material, said shielding material contacting said adhesive;

(e) a third layer of dielectric material surrounding said shielding material;

wherein said shielding material is held in place by said adhesive so as to prevent displacement of said shielding material during the application of said third layer of dielectric material.

2. The coaxial electrical cable of claim 1, wherein said shielding material comprises metal wire.

3. The coaxial electrical cable of claim 2, wherein said metal wire is spirally-wound onto the surface of said adhesive.

4. The coaxial electrical cable of claim 1, wherein said first layer of dielectric material is porous polytetrafluoroethylene.

5. The coaxial electrical cable of claim 2, wherein said first layer of dielectric material is porous polytetrafluoroethylene.

6. The coaxial electrical cable of claim 3, wherein said first layer of dielectric material is porous polytetrafluoroethylene.

7. The coaxial electrical cable of claim 4, wherein said adhesive is a heat-meltable polymer.

8. The coaxial electrical cable of claim 5, wherein said adhesive is a heat-meltable polymer.

9. The coaxial electrical cable of claim 6, wherein said adhesive is a heat-meltable polymer.

10. The coaxial electrical cable of claim 7, wherein said heat-meltable polymer is polyvinyl chloride.

11. The coaxial electrical cable of claim 8, wherein said heat-meltable polymer is polyvinyl chloride.

12. The coaxial electrical cable of claim 9, wherein said heat-meltable polymer is polyvinyl chloride.

13. The coaxial electrical cable of claim 10, wherein said tape is a polyester polymer film.

14. The coaxial electrical cable of claim 11, wherein said tape is a polyester polymer film.

15. The coaxial electrical cable of claim 12, wherein said tape is a polyester polymer film.

16. The coaxial electrical cable of claim 13, wherein said third layer of dielectric material is polyvinyl chloride.

17. The coaxial electrical cable of claim 14, wherein said third layer of dielectric material is polyvinyl chloride.

18. The coaxial electrical cable of claim 15, wherein said third layer of dielectric material is polyvinyl chloride.

19. An assembly comprising a plurality of cables as recited in claim 1 adhered together to form a multi-conductor cable.

* * * * *